US009108300B2

(12) United States Patent
Gringer et al.

(10) Patent No.: US 9,108,300 B2
(45) Date of Patent: Aug. 18, 2015

(54) SANDING DEVICE

(71) Applicant: ALLWAY TOOLS, INC., Bronx, NY (US)

(72) Inventors: Donald Gringer, New York, NY (US); Anthony Sgroi, Wallingford, CT (US)

(73) Assignee: ALLWAY TOOLS, INC., Bronx, NY (US)

( * ) Notice: Subject to any disclaimer, the term of this patent is extended or adjusted under 35 U.S.C. 154(b) by 83 days.

(21) Appl. No.: 13/732,764

(22) Filed: Jan. 2, 2013

(65) Prior Publication Data

US 2013/0324019 A1 Dec. 5, 2013

Related U.S. Application Data

(60) Provisional application No. 61/652,869, filed on May 30, 2012.

(51) Int. Cl.
*B24D 15/02* (2006.01)
*B24D 15/04* (2006.01)

(52) U.S. Cl.
CPC ..... *B24D 15/023* (2013.01); *B24D 15/04* (2013.01); *Y10T 29/49833* (2015.01)

(58) Field of Classification Search
CPC ..... B24D 15/00; B24D 15/023; B24D 15/04
USPC ..... 451/513, 517, 518, 523, 524, 525
See application file for complete search history.

(56) References Cited

U.S. PATENT DOCUMENTS

| | | | | | |
|---|---|---|---|---|---|
| 2,095,495 | A * | 10/1937 | Enge | 451/522 |
| 2,765,593 | A * | 10/1956 | Salmon et al. | 451/518 |
| 4,320,601 | A * | 3/1982 | Haney | 451/514 |
| 5,863,243 | A * | 1/1999 | Ali | 451/503 |
| 6,062,966 | A * | 5/2000 | Ali et al. | 451/503 |
| 6,960,125 | B2 * | 11/2005 | Mick | 451/525 |
| 7,112,128 | B1 * | 9/2006 | Kirschhoffer et al. | 451/499 |
| 7,144,300 | B1 * | 12/2006 | Cybulski et al. | 451/28 |
| 7,182,681 | B2 * | 2/2007 | Kirschhoffer et al. | 451/514 |
| 7,416,477 | B2 * | 8/2008 | Henke et al. | 451/344 |
| 7,500,906 | B2 * | 3/2009 | Cybulski et al. | 451/59 |
| 7,575,505 | B2 * | 8/2009 | Lamers | 451/344 |
| 7,591,715 | B2 * | 9/2009 | Cybulski et al. | 451/354 |
| 7,670,210 | B2 * | 3/2010 | Annis | 451/523 |
| 8,616,939 | B2 * | 12/2013 | Toyama | 451/525 |
| 8,696,413 | B2 * | 4/2014 | King et al. | 451/523 |
| 2005/0095968 | A1 * | 5/2005 | Mick | 451/523 |
| 2007/0212993 | A1 * | 9/2007 | Annis | 451/523 |
| 2010/0009609 | A1 * | 1/2010 | Dow et al. | 451/522 |

* cited by examiner

*Primary Examiner* — Eileen Morgan
(74) *Attorney, Agent, or Firm* — Gottlieb, Rackman & Reisman, P.C.

(57) ABSTRACT

A sanding device for use with sandpaper sheets comprises a base connected to two lateral extensions by flexible connectors. The base further includes a plurality of spikes pointed towards the extensions and positioned inside slots in the extensions when the device is in a closed position. In order to load and unload sandpaper sheets, a lateral extension may be lifted against a tension force from the flexible connector. The stress on the flexible connector is limited by the contact of two edges which are positioned to prevent the flexible connector from undergoing stress beyond a specified level.

20 Claims, 6 Drawing Sheets

SANDING DEVICE

RELATED APPLICATION(S)

This Application claims priority to U.S. Provisional Patent Application Ser. No. 61/652,869, filed on May 30, 2012, which is incorporated herein by reference.

FIELD OF THE INVENTION

The present disclosure relates to sanding devices. More particularly, the present disclosure relates to hand-held sanding devices for use with sandpaper sheets.

BACKGROUND OF THE INVENTION

Sanding devices are used for sanding a variety of surfaces. Some forms of sanding devices are manufactured with an abrasive material permanently bonded to a base structure. In one example, this type of sanding device comprises abrasive particles adhered to a foam base. When the abrasive particles are worn or clogged, the entire sanding device is discarded.

In order to mitigate the cost of discarding such sanding devices, alternate variations are also available where the sanding device is configured to interchangeably receive sandpaper sheets. The sandpaper sheets are loaded and, after use, the worn sandpaper sheet is removed and a new sandpaper sheet is subsequently loaded. Such a sanding device is molded as a single unit and typically has an extension flexibly integrated on each end to provide an open slot on each end. This sanding device further includes a series of spikes with the slot for retaining the sandpaper. The sandpaper is loaded onto the spikes when the extension is flexed away to enlarge the slot. Once the sandpaper is properly positioned, the extension is released and the slot is closed. The two extensions typically oppose one another to retain the sandpaper in two locations. One example of a prior art sanding device is shown in FIGS. 1-3.

The extensions are typically integral to the sanding device and are formed by a molding process. Rubber is a common material used for the fabrication of these types of sanding devices. Unfortunately, the excessive bending of the extensions between their more open and closed positions on a continual basis causes fatigue of the connection and often results in the extension breaking off. It has also been observed that if the extensions are over flexed to an extreme position during a single use, breakage may occur. Once breakage has occurred, the sanding device cannot function as intended and is usually discarded.

Therefore, there is a need for sanding devices that overcome, alleviate, and/or mitigate one or more of the aforementioned and other drawbacks of prior art sanding devices.

BRIEF SUMMARY OF THE INVENTION

A sanding device for use with sandpaper sheets comprises a base having a first extension located on a first end and a second extension located on a second end. A plurality of spikes is affixed to the base and extends from the base into slots defined by the space between the base and the extensions. The spikes are used to secure a sheet of sandpaper to the sanding device. The first and second extensions are flexibly connected to the base allowing a user to adjust either extension to a more open position in order to reveal the spikes and load or unload a sandpaper sheet.

Each extension is connected to the base by a flexible connector. The flexible connector is a length of semi-flexible material (e.g., polypropylene), which extends substantially across the width of the sanding device. The flexible connector connects an edge of the base and an inner edge of the extension. In a closed position, the two edges are separated by a gap. When the extension is opened to further open the slot and to reveal the spikes, the two edges come together and substantially close the gap. The contact between the two edges limits the degree of opening and thereby reduces or limits the stress on the flexible connector.

DETAILED DESCRIPTION OF THE INVENTION

Figure 1:
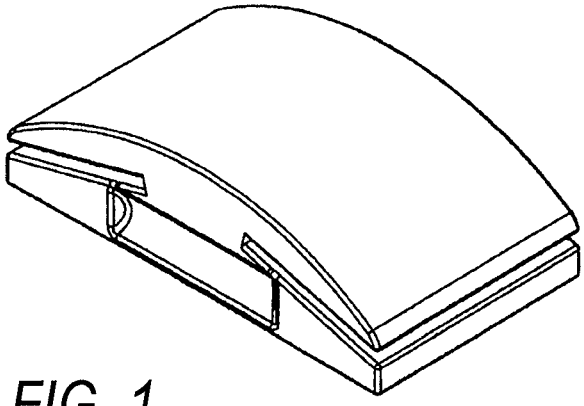
FIG. 1 (PRIOR ART)
FIG. 1 is an perspective view of a prior art sanding device.
Figure 2:
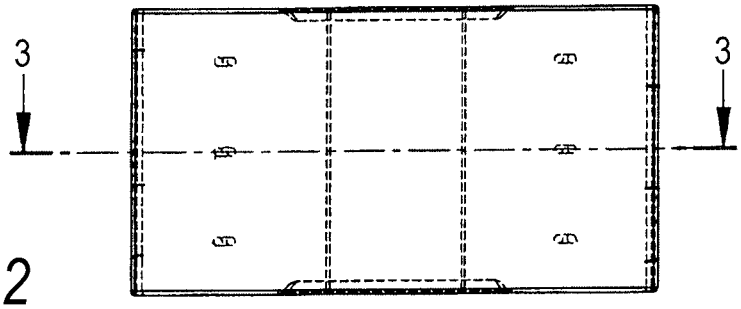
FIG. 2 (PRIOR ART)
FIG. 2 is a top view thereof.
Figure 3:
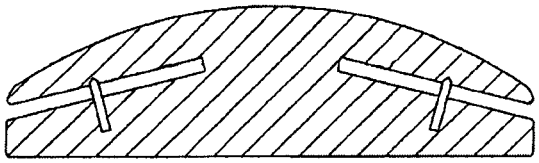
FIG. 3 (PRIOR ART)
FIG. 3 is a cross-sectional view thereof, taken from line 3-3 from FIG. 2.
Figure 4:
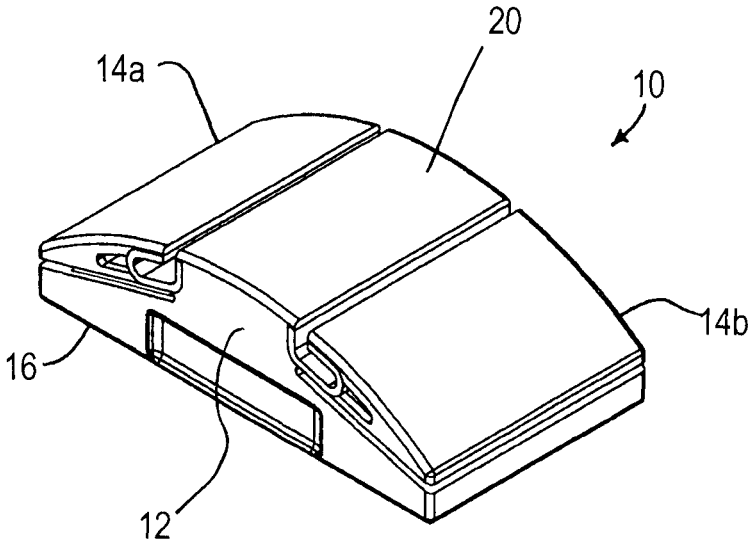
FIG. 4 is a top perspective view of an exemplary embodiment of a sanding device according to the present disclosure.
Figure 5:
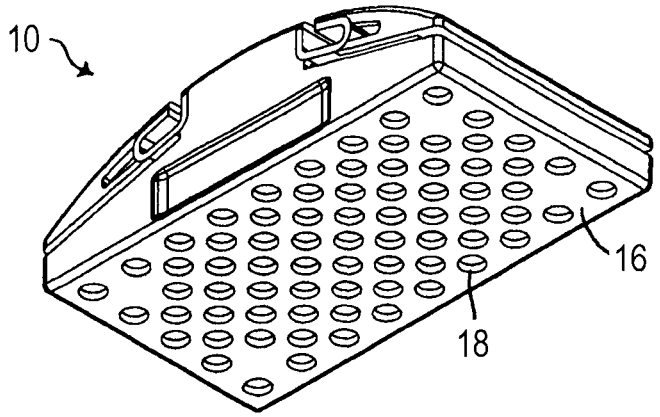
FIG. 5 is a bottom perspective view thereof.
Figure 6:
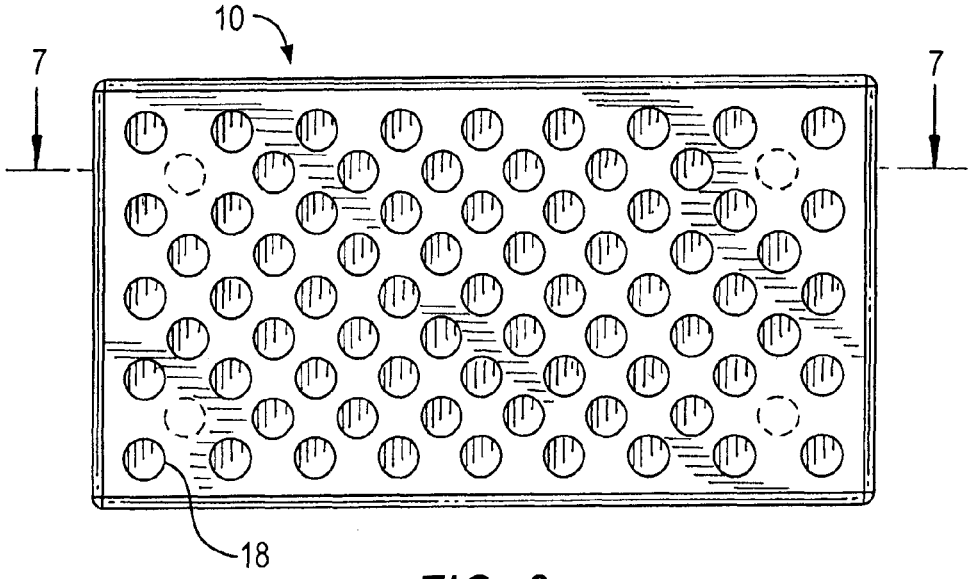
FIG. 6 is a bottom view thereof.

Referring to the drawings and in particular to FIGS. 4 through 7, a sanding device according to an exemplary embodiment of the present disclosure is shown having reference numeral 10. Sanding device 10 includes a dome-shaped base 12 and a pair of lateral extensions 14, namely 14*a* and 14*b*. The sanding device 10 further has a bottom 16, formed with a plurality of vertical cutouts 18, and a top 20. The sanding device 10 is adapted to secure a sheet of standard sandpaper S and to provide an ergonomic, smooth, and curved handle for engaging the sheet of sandpaper S with a surface being sanded. The sandpaper S is secured by a plurality of spikes 22*a* and 22*b* fixed to and extending from the base 12, where the spikes 22 are positioned within the lateral extensions 14*a*, 14*b*.

The first lateral extension 14*a* (where an aspect of the invention is described only for the first extension 14*a*, it should be presumed that the device 10 may be constructed and operated with a matching element of the second extension 14*b*) is attached to the base 12 at a first end by a first flexible connector 26*a*. In the exemplary embodiment, the flexible connector 26*a* comprises a length of material, which extends from the front to the back of the sanding device 10. The flexible connector 26 may be made thicker or thinner in order to vary the tension it provides.

Figure 7:
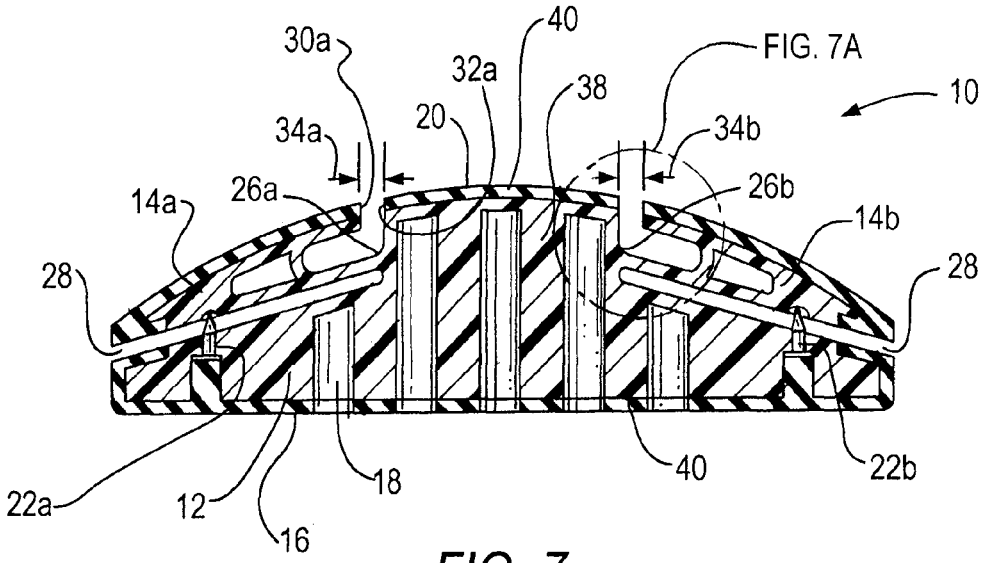
FIG. 7 is a cross-sectional view thereof, taken from line 7-7 from FIG. 6.
Figure 7A:
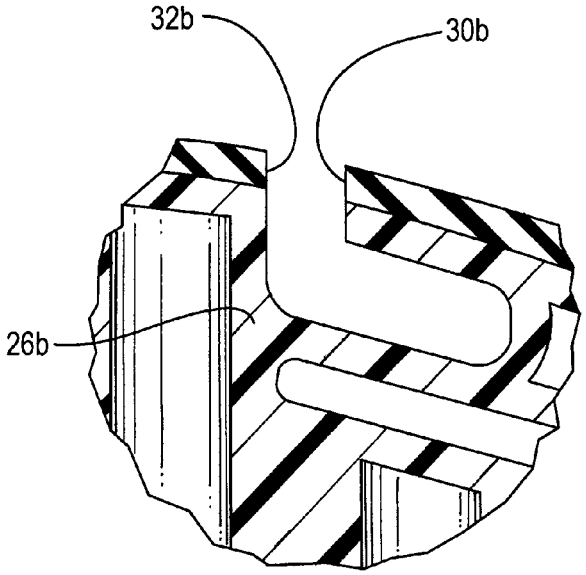
FIG. 7A is an enlarged view of the flexible connector taken from FIG. 7.

As illustrated in FIG. 7, there is an elongated slot 28 between the base 12 and the first extension 14*a*. As will be discussed below, a sheet of sandpaper is secured within the slot 28.

According to the exemplary embodiment, the flexible connectors 26*a* and 26*b* extend from the front to the back of the sanding device and include an inner edge 30*a* of the lateral extension 14*a* and a top edge 32*a* of the base 12. The inner edge 30*a* of the lateral extension 14*a* and the top edge 32*a* of the base 12 are separated by a gap 34*a*. The edges 30*a* and 32*a* may act as blocking edges, as discussed herein.

Figure 7B:
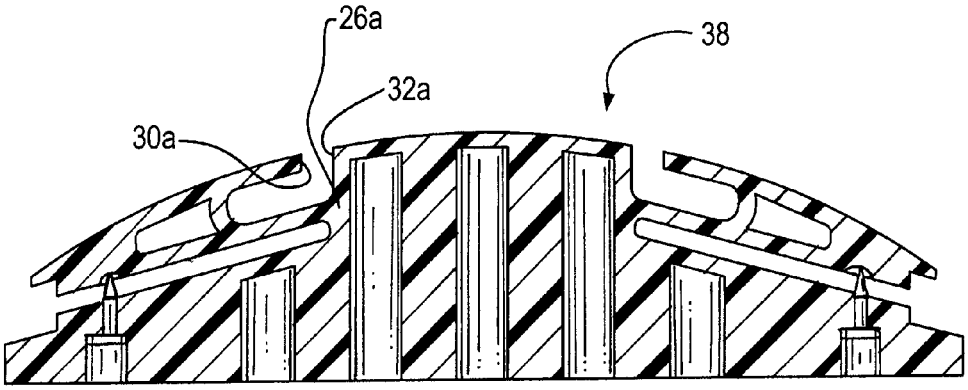
FIG. 7B is a cross-sectional view of the interior structure of the exemplary embodiment of a sanding device, with the exterior structure 40 removed for clarity.
Figure 8:
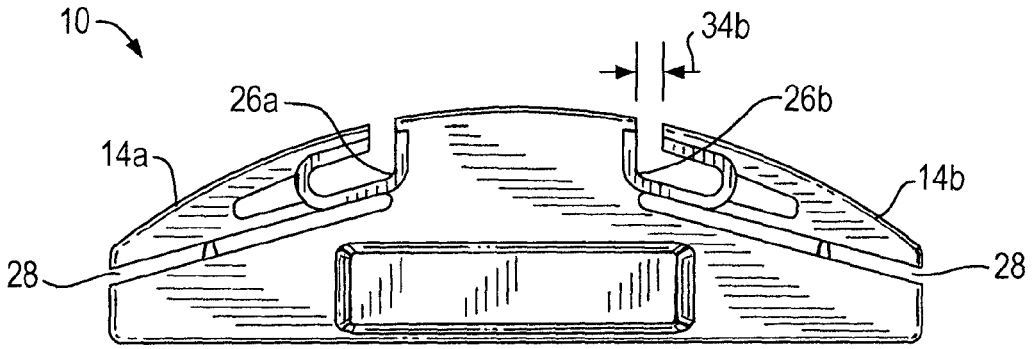
FIG. 8 is a side view of the exemplary embodiment of FIG. 4.

In the exemplary embodiment shown in FIG. 7, the base 12 includes an interior structure 38 and an exterior structure 40. The interior structure 38 has a skeleton structure and is shown in isolation in FIG. 7B. The interior structure 38 is preferably made of a light weight, hard, and semi-flexible material such as polypropylene, nylon, etc. The interior structure 38 may be manufactured using an injection molding process. Alternatively, a soft elastomer (e.g., Santoprene™, TPE, TPR, etc.) is over molded. It is preferred that the flexible connector 26*a* and the interior structure 38 are a singularly formed structure.

The exterior structure 40, which extends around the exterior of the sanding device 10, including both the base 12 and the extensions 14*a*, 14*b*, is constructed of a softer over-molded material having similar qualities to rubber. In particular, the exterior structure 40 has a lower durometer than the interior structure 38 and may be, for example, an injection molded thermoplastic elastomer such as Santoprene™. In the exemplary embodiment shown in FIG. 7, the exterior structure 40 is over-molded onto the interior structure 38.

In an alternative embodiment, the interior structure 38 and the exterior structure 40 may be combined and thus constructed of the same material. In the alternative embodiment, it is preferred that the harder material of the interior structure be used.

Figure 9:
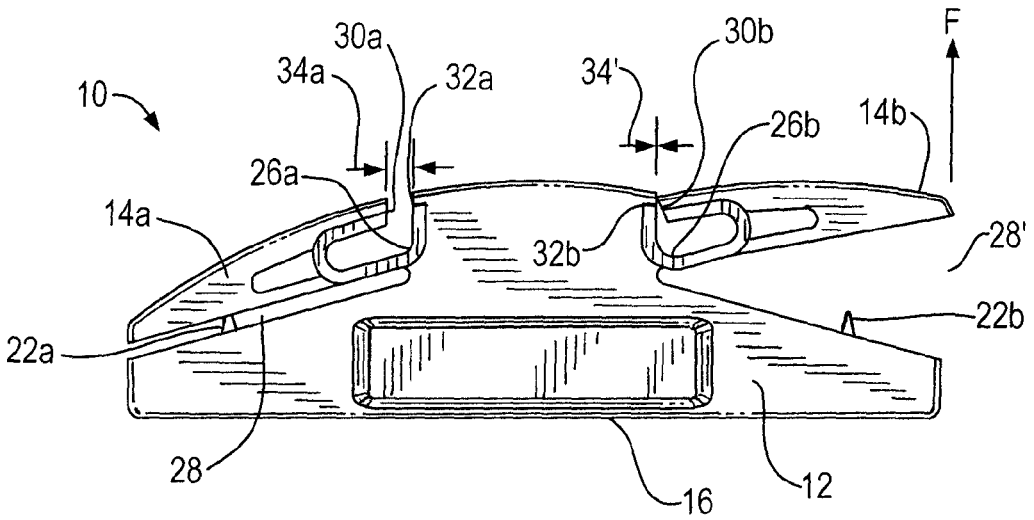
FIG. 9 is a side view of the sanding device of the exemplary embodiment showing an extension of the sanding device in a flexed or open state.

Referring to FIG. 9, in order to load and unload sandpaper sheets S (see FIG. 10), the extensions 14*a*, 14*b* may be lifted away from the spikes 22 opening the slot 28 to allow a sandpaper sheet S to be inserted into the slot 28. The extension 14*b* is opened by a hand-applied upward force F on the end of the extension 14*b* which causes the flexible connector 26*b* to bend against its own tension. This movement further causes the inner edge 30*b* of the lateral extension 14*b* to contact the top edge 32*b* of the base 12 resulting in an enlarged wedge-like space 28' between the lateral extension 14*b* and the base 12. Additionally, when inner edge 30*b* of the lateral extension 14*b* contacts the top edge 32*b* of the base 12, the gap 34' is either minimized or reduced to zero. In the latter state, the edge 32*b* acts as a stop to prohibit further opening of the extension 14*b*.

The tension of the flexible connector 26*b* should be sufficient to maintain the sanding device 10 in the closed position other than when a user is specifically intending to open the device 10. The contact between the two edges 30*b*, 32*b* limits the amount the flexible connector 26*b* may bend, thereby limiting the range of motion and thereby limiting the amount of tension the flexible connector 26*b* experiences. Specifically, the edge of the base 32*b* and the inner edge 30*b* of the lateral extension 14*b* are positioned to limit the stress on the flexible connector 26*b* to a predetermined level such as a stress below the yield stress of the material used to construct the flexible connector 26*b*. Moreover, it is preferred that the edge 32*b* of the base 12 and the inner edge 30*b* of the lateral extension 14*b* are positioned to limit the maximum stress on the flexible connector 26*b*, when the lateral extension 14*b* is moved between the open position and the closed position, to a level that the flexible connector 26*b* can withstand for the lifetime of the device 10.

Figure 12:
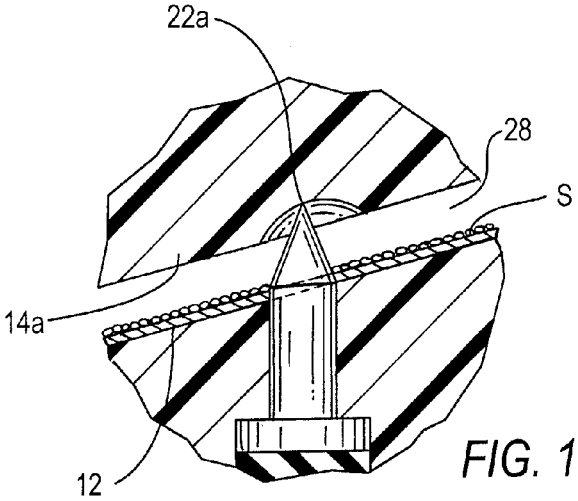
FIG. 12 is a detailed view of the spike positioned inside a slot in an extension taken from FIG. 11.

With the lateral extension 14*b* in the open position shown in FIG. 9, one end of a sheet of sandpaper S is inserted into the slot 28' with the abrasive side of the sandpaper S facing towards the lateral extension 14*b*. The sheet of sandpaper is then pierced by the spike 22*b* as shown in FIG. 12, thereby securing the sheet of sandpaper S to the sanding device 10. If necessary, the lateral extension 14*b* may be compressed towards the base 12 in order to press the sandpaper S against the spike 22*b* and facilitate piercing of the sandpaper S by the spike 22*b*.

Figure 10:
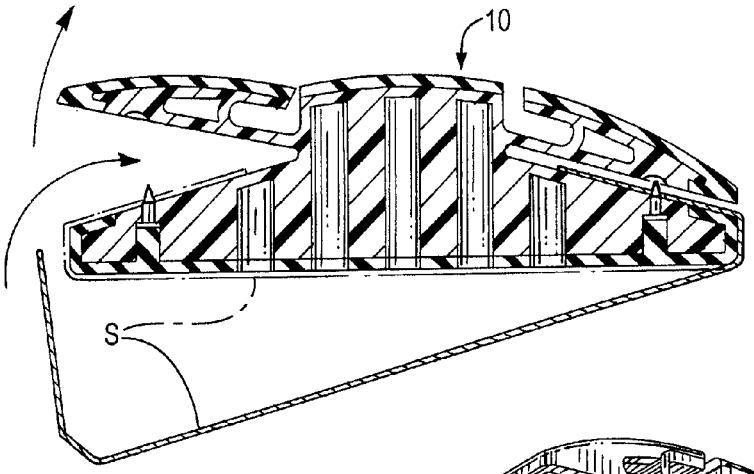
FIG. 10 is a bottom perspective view of the sanding device of the exemplary embodiment shown with a sheet of sandpaper loaded thereto.
Figure 11:
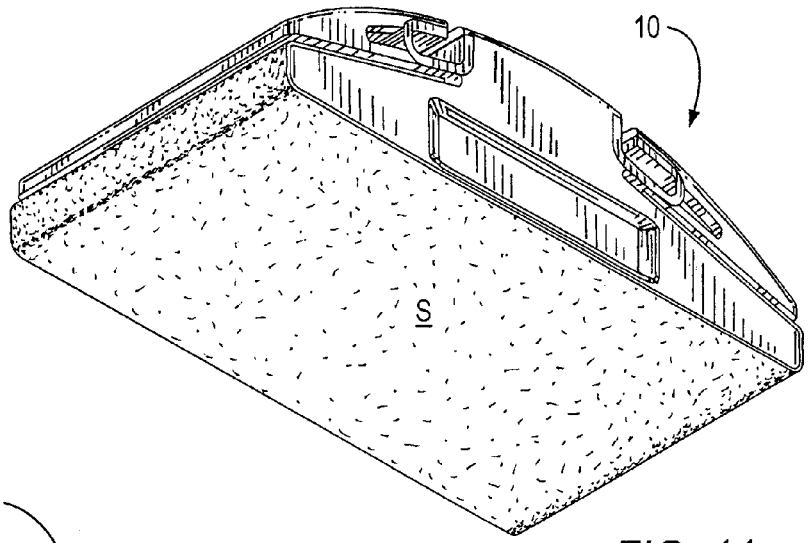
FIG. 11 is a cross sectional view thereof, taken from FIG. 10 illustrating the cross section along the center of the sanding device.

Next, the sheet of sandpaper S is wrapped around the bottom 16 of the sanding device 10 and the opposite end of the sheet of sandpaper S is similarly secured to the spikes 22*a* of the opposite end of the base 12 as illustrated in FIGS. 10 and 11. When securing the second end of the sandpaper, care should be used to ensure that the sandpaper S is taught against the bottom 16 of the sanding device 10 with the abrasive side of the sandpaper S facing outward.

Once the sheet of sandpaper S is secured to the spikes 22*a*, 22*b*, the lateral extension 14*a* is returned to the closed position where the positioning of the spikes 22*a*, 22*b* within the lateral extensions 14*a*, 14*b* prevents the sheet of sandpaper S from moving relative to the sanding device 10.

It should also be noted that the terms "first", "second", "third", "upper", "lower", and the like may be used herein to modify various elements. These modifiers do not imply a spatial, sequential, or hierarchical order to the modified elements unless specifically stated.

The accompanying drawings only illustrate exemplary embodiments of a sanding device and their respective constituent parts, however, other types and styles are possible, and the drawings are not intended to be limiting in that regard. Thus, although the description above and accompanying drawings contains much specificity, the details provided should not be construed as limiting the scope of the embodiments but merely as providing illustrations of some of the presently preferred embodiments. The drawings and the description are not to be taken as restrictive on the scope of the embodiments and are understood as broad and general teachings in accordance with the present invention. While the present embodiments of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention.

The invention claimed is:

1. A sanding apparatus for use with interchangeable sandpaper sheets, comprising:

a base including a top portion adapted to be gripped by a user and a bottom portion adapted to be encompassed by one of the sandpaper sheets;

a lateral extension including a first end and a second end, the lateral extension being spaced from the bottom portion of the base defining a slot between the lateral extension and the bottom portion of the base for receiving a portion of one of the sandpaper sheets; and a flexible connector formed integral with and extending from the first end of the lateral extension and contiguous to and integral with a sidewall of the top portion of the base, connecting the lateral extension to the base, wherein the flexible connector has a first end extending from the sidewall of the top portion of the base and a second end spaced from the first end of the flexible connector forming a gap between the first end and the second end of the flexible connector, the gap extending within the flexible connector toward the lateral extension defining a cavity therein, wherein the lateral extension is biased to a closed position by the flexible connector and moveable to an open position upon an application of tensional force on the lateral extension and the flexible connector, and whereby, in a closed position, the first end and the second end of the flexible connector are separated from each other by the gap and in the open position, the flexible connector is bendable such that the second end of the flexible connector is moveable toward the first end of the flexible connector and the top portion of the base and the second end of the flexible connector is contactable with the top portion of the base to limit strain to the flexible connector.

2. The sanding apparatus of claim 1, wherein the base and the lateral extension include an interior structure and an exterior structure that substantially encompasses the interior structure.

3. The sanding apparatus of claim 2, wherein the interior structure is comprised of a first thermoplastic material and the exterior structure is comprised of a second thermoplastic material and the first thermoplastic material has a higher durometer than the second thermoplastic material.

4. The sanding apparatus of claim 2, wherein the flexible connector is formed integral with the interior structure.

5. The sanding apparatus of claim 1, further comprising a second lateral extension extending from a side of the base that is mirror opposite that of the lateral extension, and spaced from the base to define a second slot between the second lateral extension and the base to receive a second portion of one of the sand paper sheets.

6. The sanding apparatus of claim 1, wherein the flexible connector is comprised of semi-flexible material.

7. The sanding apparatus of claim 1, further comprising at least one spike extending from the base toward the lateral extension that is at least contactable with the lateral extension in the closed position.

8. The sanding apparatus of claim 1, wherein the sidewall of the top portion and the second end of the flexible connector are positioned to limit stress on the flexible connector to a stress below a yield stress of a material used to construct the flexible connector.

9. The sanding apparatus of claim 1, further comprising a second lateral extension including a first end and a second end, the second lateral extension being spaced from the bottom portion of the base defining a slot between the lateral extension and the bottom portion of the base for receiving a portion of one of the sandpaper sheets and a second flexible connector formed integral with and extending from a second end of the second lateral extension and contiguous to and integral with a second sidewall of the top portion of the base, connecting the second lateral extension to the base.

10. A sanding apparatus for use with interchangeable sandpaper sheets, comprising:

a base including a top portion adapted to be gripped by a user and a bottom portion adapted to be encompassed by one of the sandpaper sheets;

a lateral extension including a first end and a second end, the lateral extension being spaced from the base to define a slot therebetween to receive a portion of one of the sandpaper sheets;

a flexible connector formed integral with and extending from the first end of the lateral extension and contiguous to and integral with a sidewall of the top portion of the base; and a spike extending from the base into the slot that is adapted to interchangeably secure the portion of one of the sandpaper sheets to the sanding apparatus, wherein the flexible connector has a first end extending from the sidewall of the top portion of the base and a second end spaced from the first end of the flexible connector forming a gap between the first end and the second end of the flexible connector, the gap extending within the flexible connector toward the lateral extension defining a cavity therein, and wherein the lateral extension is biased to a closed position by the flexible connector and moveable to an open position upon an application of tensional force on the lateral extension and the flexible connector, and the flexible connector is adapted to limit movement defined by the gap between the sidewall of the base and the second end of the flexible connector.

11. The sanding apparatus of claim 10, wherein the base and the lateral extension include an interior structure having a plurality of cutouts and an exterior structure that substantially encompasses the interior structure.

12. The sanding apparatus of claim 11, wherein the interior structure is comprised of a first thermoplastic material and the exterior structure is comprised of a second thermoplastic material and the first thermoplastic material has a higher durometer than the second thermoplastic material.

13. The sanding apparatus of claim 11, wherein the flexible connector is formed integral with the interior structure.

14. The sanding apparatus of claim 10, further comprising a second lateral extension extending from a side of the base that is mirror opposite that of the lateral extension.

15. The sanding apparatus of claim 10, wherein the flexible connector is comprised of semi-flexible material.

16. The sanding apparatus of claim 10, wherein the sidewall of the top portion and the inner edge second end of the lateral extension are positioned to limit stress on the flexible connector to a stress below a yield stress of a material used to construct the flexible connector.

17. The sanding apparatus of claim 10, further comprising a second lateral extension including a first end and a second end, the second lateral extension being spaced from the base defining a slot between the lateral extension and the base for receiving a portion of one of the sandpaper sheets and a second flexible connector formed integral with and extending from a second end of the second lateral extension and contiguous to and integral with a second sidewall of the base, connecting the second lateral extension to the base.

18. A method of securing a sheet of sandpaper to a sanding apparatus comprising a base including a top portion adapted to be gripped by a user and a bottom portion adapted to be encompassed by one of the sandpaper sheets, a first lateral extension including a first end and a second end, the first lateral extension being spaced from the base to define a slot therebetween to receive a portion of one of the sandpaper sheets, a first flexible connector formed integral with and extending from the first end of the first lateral extension and contiguous to and integral with a first sidewall of the top portion of the base forming a gap between the top portion first sidewall and first end of first lateral extension, a second lateral extension including a first end and a second end, the second lateral extension being spaced from the base to define a slot therebetween to receive a portion of one of the sandpaper sheets and, a second flexible connector formed integral with and extending from the first end of the second lateral extension and contiguous to and integral with a second sidewall of the top portion of the base forming a gap between the top portion second sidewall and first end of second lateral extension which is mirror opposite the first sidewall of the top portion of the base, the method comprising the steps of:

lifting the first lateral extension from a biased, closed position by the first flexible connector and applying tension to the first lateral extension and the first flexible connector with the second end of the first flexible connector being contactable with the first sidewall of the base to limit strain to the first flexible connector;

inserting a first end of a sheet of sandpaper between the base and the first lateral extension;

securing the sheet of sandpaper between the base and the first lateral extension;

releasing the first lateral extension and the first flexible connector and allowing the first lateral extension and the first flexible connector to return to the biased, closed position;

lifting the second lateral extension and the second flexible connector from a biased, closed position and applying tension to the second lateral extension and the second flexible connector with the second end of the second flexible connector being contactable with the second sidewall of the base to limit strain to the second flexible connector;

inserting a second end of the sheet of sandpaper between the base and the second lateral extension;

securing the sheet of sandpaper between the base and the second lateral extension; and releasing the second lateral extension and the second flexible connector and allowing the second lateral extension and the second flexible connector to return to the biased, closed position.

19. The method of claim 18, wherein the first end of the sheet of sandpaper is secured by puncturing the sheet of sandpaper with a first spike that is fixed to the base, extends toward the first lateral extension and is contactable with the first lateral extension in a closed position.

20. The method of claim 18, wherein the second end of the sheet of sandpaper is secured by puncturing the sheet of sandpaper with a second spike that is fixed to the base, extends toward the second lateral extension and is contactable with the second lateral extension in a closed position.

* * * * *